US006530742B2

(12) United States Patent
Trinler et al.

(10) Patent No.: US 6,530,742 B2
(45) Date of Patent: Mar. 11, 2003

(54) TELESCOPIC BOOM ROUTING ASSEMBLY FOR TRANSMISSION LINES

(75) Inventors: Martin Trinler, Mannheim (DE); Richard Tudor, Zweibrucken (DE)

(73) Assignee: Deere & Company, Moline, IL (US)

( * ) Notice: Subject to any disclaimer, the term of this patent is extended or adjusted under 35 U.S.C. 154(b) by 0 days.

(21) Appl. No.: 09/899,050

(22) Filed: Jul. 5, 2001

(65) Prior Publication Data

US 2002/0006326 A1 Jan. 17, 2002

(30) Foreign Application Priority Data

Jul. 5, 2000 (DE) ..... 100 32 585

(51) Int. Cl.[7] ..... B66C 23/00

(52) U.S. Cl. ..... 414/718; 414/918; 52/118; 212/348

(58) Field of Search ..... 414/718, 723, 414/918; 52/118; 212/348, 349

(56) References Cited

U.S. PATENT DOCUMENTS 3,623,501 A 11/1971 Reimbold
3,893,480 A 7/1975 Dunbar
3,985,248 A 10/1976 Liegel et al.

FOREIGN PATENT DOCUMENTS

| | | |
|---|---|---|
| DE | 2 141 424 | 3/1972 |
| DE | 32 36 894 | 3/1988 |
| DE | 44 35 334 | 6/2000 |
| EP | 0 567 363 | 10/1993 |
| EP | 0 623 092 | 2/1997 |

*Primary Examiner*—Donald W. Underwood

(57) ABSTRACT

A telescopic boom arrangement of a vehicle is provided with a fixed, tubular outer boom and an inner boom which is mounted for sliding within the outer boom. Transmission lines for coupling various functions, carried at the end of the inner boom, with a power source/and or controls include an intermediate section mounted to the outer boom by a transmission line routing assembly which holds first ends of the intermediate section of the transmission lines at a fixed location and establishes a guide along which second ends of the section of transmission lines is moveable lengthwise of the outer boom. The intermediate section of the transmission lines is flexible and defines a bow which changes in length as the inner boom extends and retracts relative to the outer boom.

12 Claims, 5 Drawing Sheets

TELESCOPIC BOOM ROUTING ASSEMBLY FOR TRANSMISSION LINES

FIELD OF THE INVENTION

The invention concerns a telescopic boom and more particularly relates to a routing assembly for transmission lines contained in the boom.

BACKGROUND OF THE INVENTION

On telescopic booms of vehicles, particularly on telescoping loaders and the like, transmission lines are frequently routed that are used to transmit hydraulic, electrical and/or pneumatic power and/or to transmit signals, in order to drive, for example, hydraulic or pneumatic cylinders, valves and electric motors or to accept inputs of measurement values. In order to make possible an equalization of the lengths of the transmission lines upon the retracting and extending of two telescoping sections of the boom, it is usual practice (EP-B-0 623 092, U.S. Pat. No. 3,623,501) to employ flexible transmission lines that are conducted in a wide arc, each of whose ends is fastened to one of the two telescoping sections that can be moved relative to each other. The direction and routing of these transmission lines, however, is frequently difficult. Since the transmission lines are usually conducted in bundles, maintenance operations or the replacement of the lines are difficult to perform.

From U.S. Pat. No. 3,985,248, a telescopic boom arrangement has become known in which two flexible line sections extending in the form of a loop are fastened at one end to an outer boom section and at the other end to an inner boom section. Each loop is conducted in the opposite direction over an associated pulley. The two pulleys are supported in bearings on a slide guided on a guide rod. During extension and retraction of the boom, the slide shifts and thereby an equalization of the length of the line sections takes place. This configuration is relatively costly and requires a large amount of justification and maintenance.

SUMMARY OF THE INVENTION

According to the present invention, there is provided a routing arrangement for transmission lines which overcomes the problems attendant with the routing arrangements of the prior art.

An object of the invention is to provide a simple, economical assembly for reliably routing transmission lines used with a telescopic boom.

A more specific object is to provide a transmission line mounting frame to which is fixed a first transmission line receptacle holding first ends of transmission lines and a guide assembly on which a second receptacle, in the form of a slide and holding second ends of the transmission lines, is mounted for reciprocating along the guide assembly, with a flexible bow being located in the transmission lines between the first and second receptacles.

Yet a more specific object is to provide a mounting frame, as defined in the immediately previous object, wherein a plate extends longitudinally of the mounting frame for supporting and guiding the bow portion of the transmission lines.

Still another specific object is to provide a transmission line routing assembly as defined in one or more of the previous objects, wherein the transmission lines extending between the first and second receptacles are an intermediate section having opposite ends adapted for connection to further transmission line sections respectively carried by the boom vehicle and by a telescoping boom section.

These and other objects of the invention will become apparent from a reading of the present description together with the appended drawings.

DESCRIPTION OF THE PREFERRED EMBODIMENT

Figure 1:
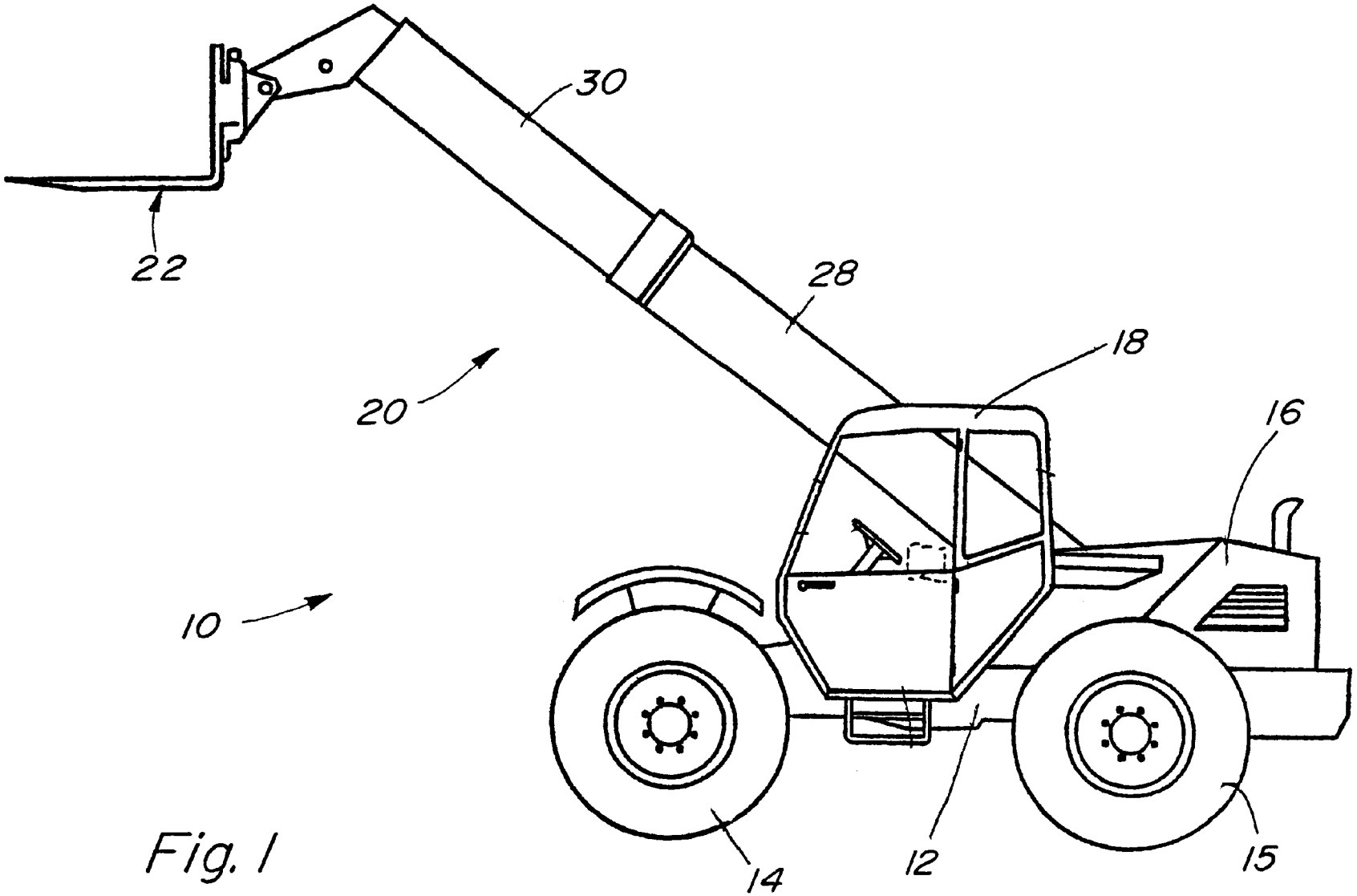
FIG. 1 is a left side elevational view of a telescoping loader with a boom with which the present invention is particularly adapted for use.

Referring now to FIG. 1, there is shown a telescoping loader 10 including a chassis 12, front and rear pairs of wheels 14 and 15, respectively, an engine compartment 16, an operator's cab 18, and a boom 20 having an implement 22 coupled to its free end, to the front end. Now referring also to FIGS. 2 and 3, there is shown a pivot pin 26 for joining the rear end of the boom 20 to the chassis 12 and defining a horizontal pivot axis about which the boom may be pivoted by a hydraulic cylinder 24, so that the implement 22 can be raised and lowered. The boom 20 consists essentially of a first outer boom section (outer boom 28) and a second inner boom section (inner boom 30), where the inner boom 30 is guided in the usual manner telescoping in the outer boom 28. The retraction and extension of the inner boom 30 is performed by a hydraulic cylinder, not shown.

Figure 4:
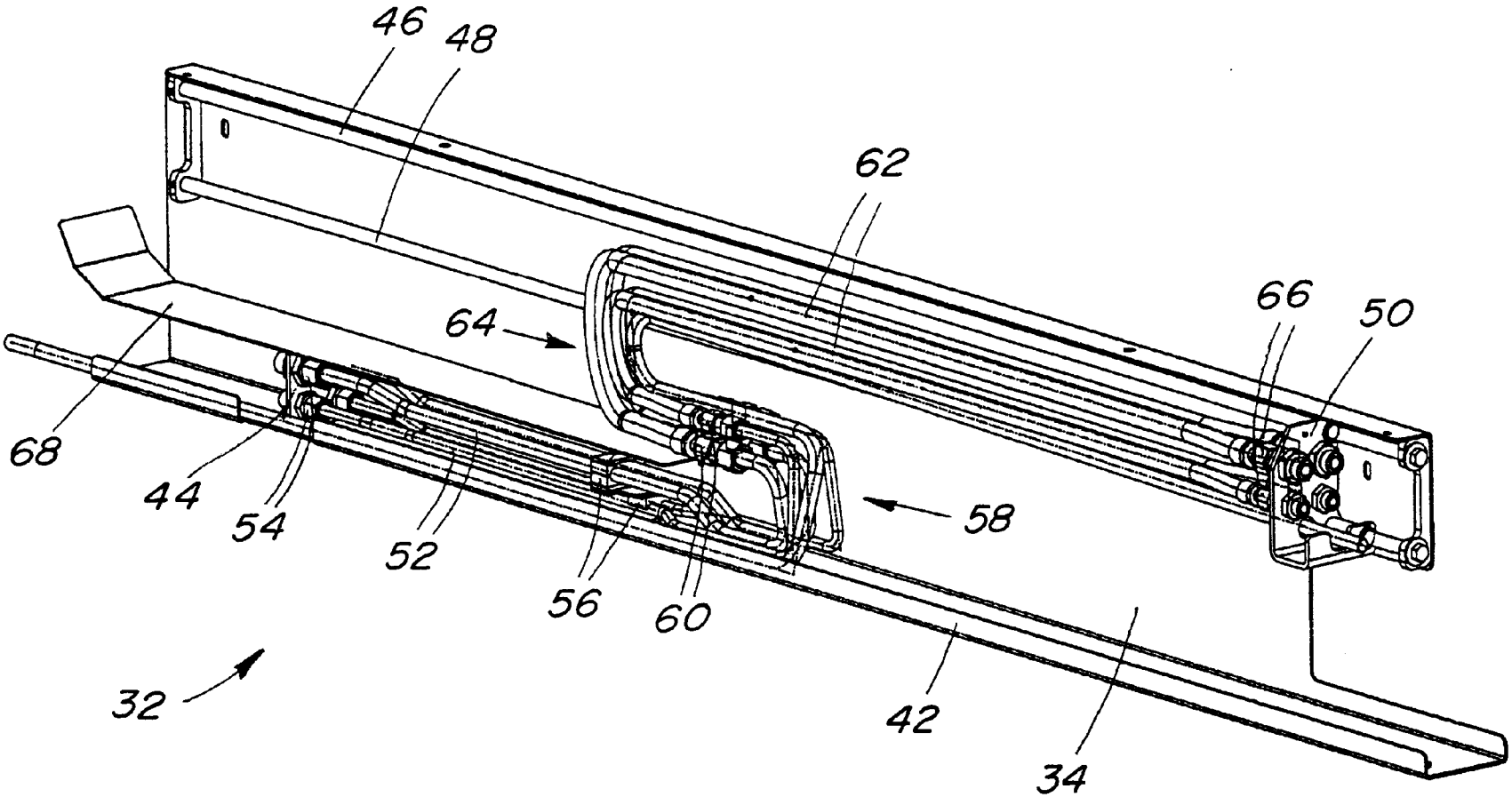
FIG. 4 is a perspective view of a mounting frame supporting the transmission line routing arrangement.
Figure 5:
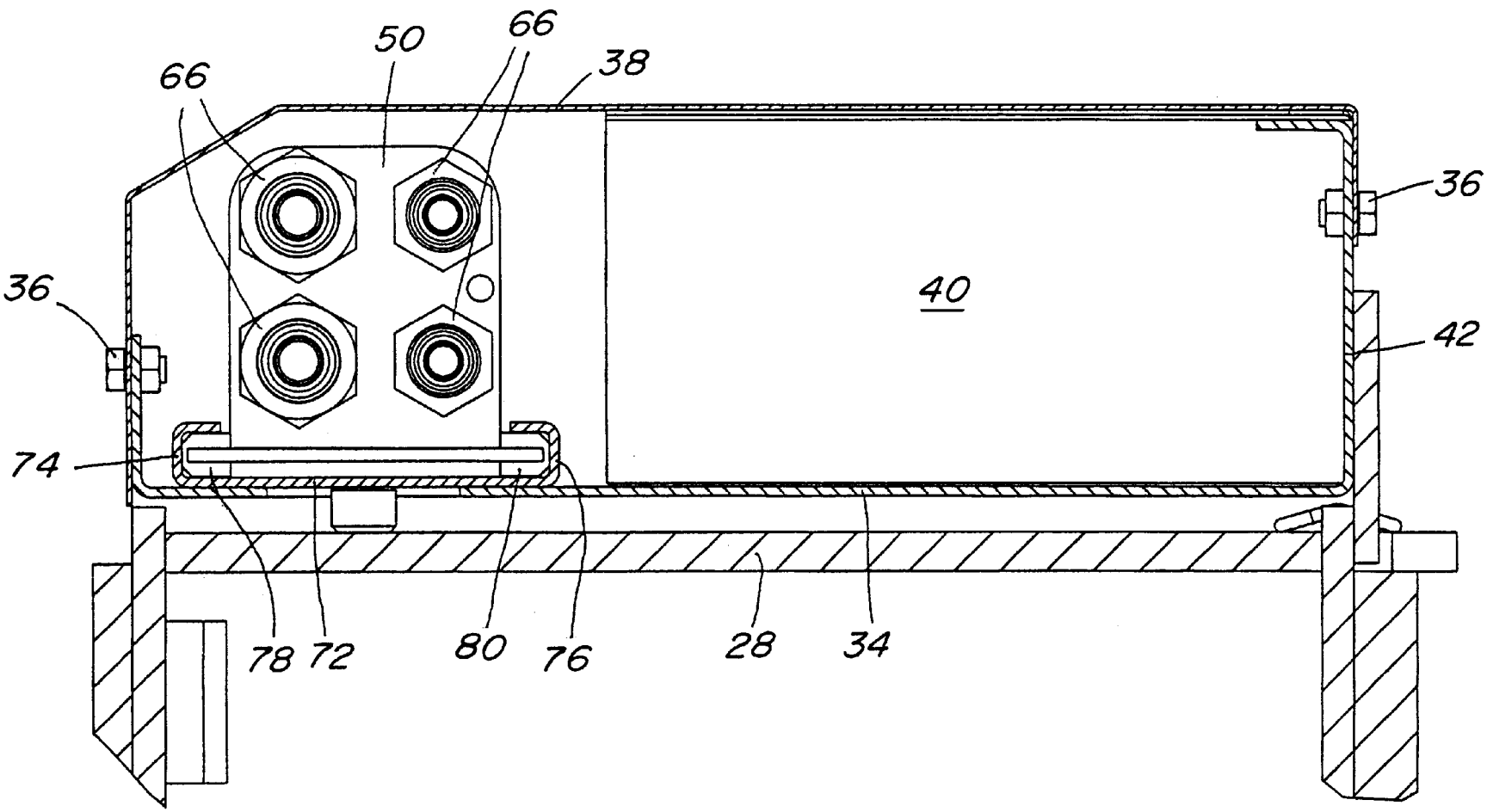
FIG. 5 is a sectional view taken through a mounting frame constructed in accordance with the present invention.

A mounting frame 32 is fastened at the side of the outer boom 28, which is shown in an enlarged view in FIG. 4. The mounting frame 32 consists essentially of a base frame 34 extended in the longitudinal direction, i.e., lengthwise of the boom 28. Referring also to FIG. 5, it can be seen that the frame 32 is a formed piece and that a cover 38 is releasably fastened to the base frame 34 by screws 36 so as to cooperate with the base frame 34 to define a hollow chamber 40.

The lower region 42 of the base frame 34 is configured generally in a U-shape. In this region 42 a first receptacle 44 is rigidly fastened on the side of the base frame 34 facing the pivot axis 26 and that is configured as a bulkhead wall extending transverse to the longitudinal direction of the base frame 34. In the upper region of the base frame 34, a guidance arrangement is fastened that consists essentially of parallel, cylindrical guide rods 46 and 48, extending in the longitudinal direction of the base frame 34 and with the rod 46 being arranged above the rod 48. A second receptacle 50 is supported in appropriate sliding bearings on the guide rods 46 and 48. The second receptacle 50 can be slid along the length of the guide rods 46 and 48. The receptacle 50 consists generally of a sheet metal component bent at angles in the form of a profile that is configured as a bulkhead wall in regions similar to the first receptacle 44 and is oriented transverse to the longitudinal direction of the base frame 34.

Since the first receptacle 44 is arranged in the lower region and the second receptacle 50 is arranged in the upper region of the base frame 32, they are at least offset to the side with respect to the longitudinal direction and are not aligned with each other.

The first receptacle 44 is used as a fixed support point for four rigid individual tubes 52 that are fastened to the first receptacle 44 by means of bores in the bulkhead wall as well as screw connections 54. Two individual tubes 52 in each case are bundled by means of clamps 56 into tube packages and fixed to the base frame 34. The individual tubes 52 extend in a rigid 180° bow 58 and end at connecting points 60, that are oriented in the same direction as the ends of the tubes in the region of the first receptacle 44. The connecting points 60 contain screw connections for fastening flexible hoses 62. Since the connecting points 60 are rigidly connected to the base frame 34, they form fixed points for the flexible hoses 62. These hoses 62 extend in a generally J-shaped or U-shaped 180° bow 64 up to the second receptacle 50. They are fastened to the receptacle 50 by means of screw fasteners 66. When the receptacle is shifted along the guide rods 46 and 48, a length equalization of the lengths of the legs of the J-shaped bow or the U-shaped bow 64 of the flexible hoses 62 is performed.

Figure 2:
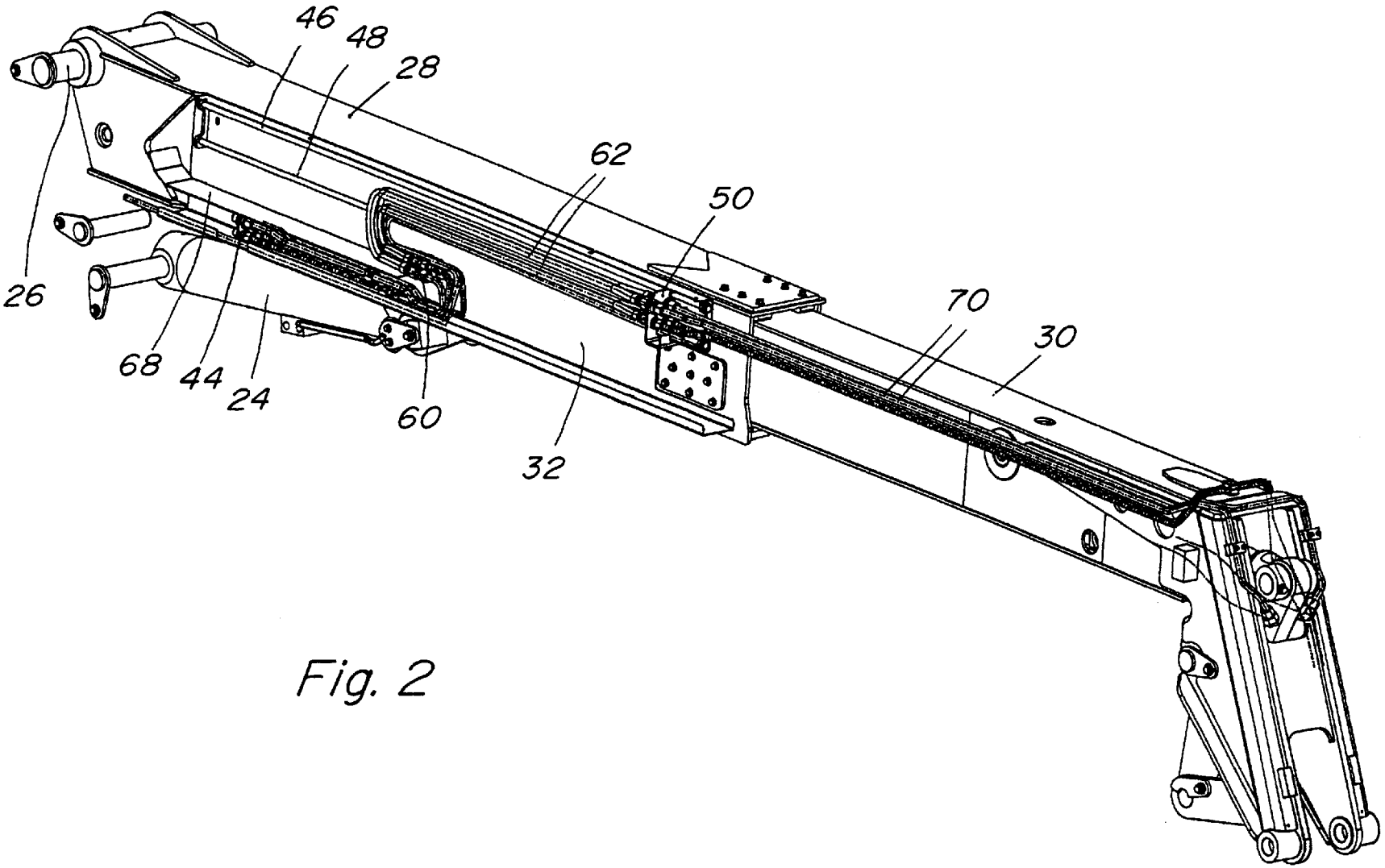
FIG. 2 is a right front perspective view of the telescopic boom equipped with a transmission line routing arrangement according to the present invention, with the boom being shown in an extended position.
Figure 3:
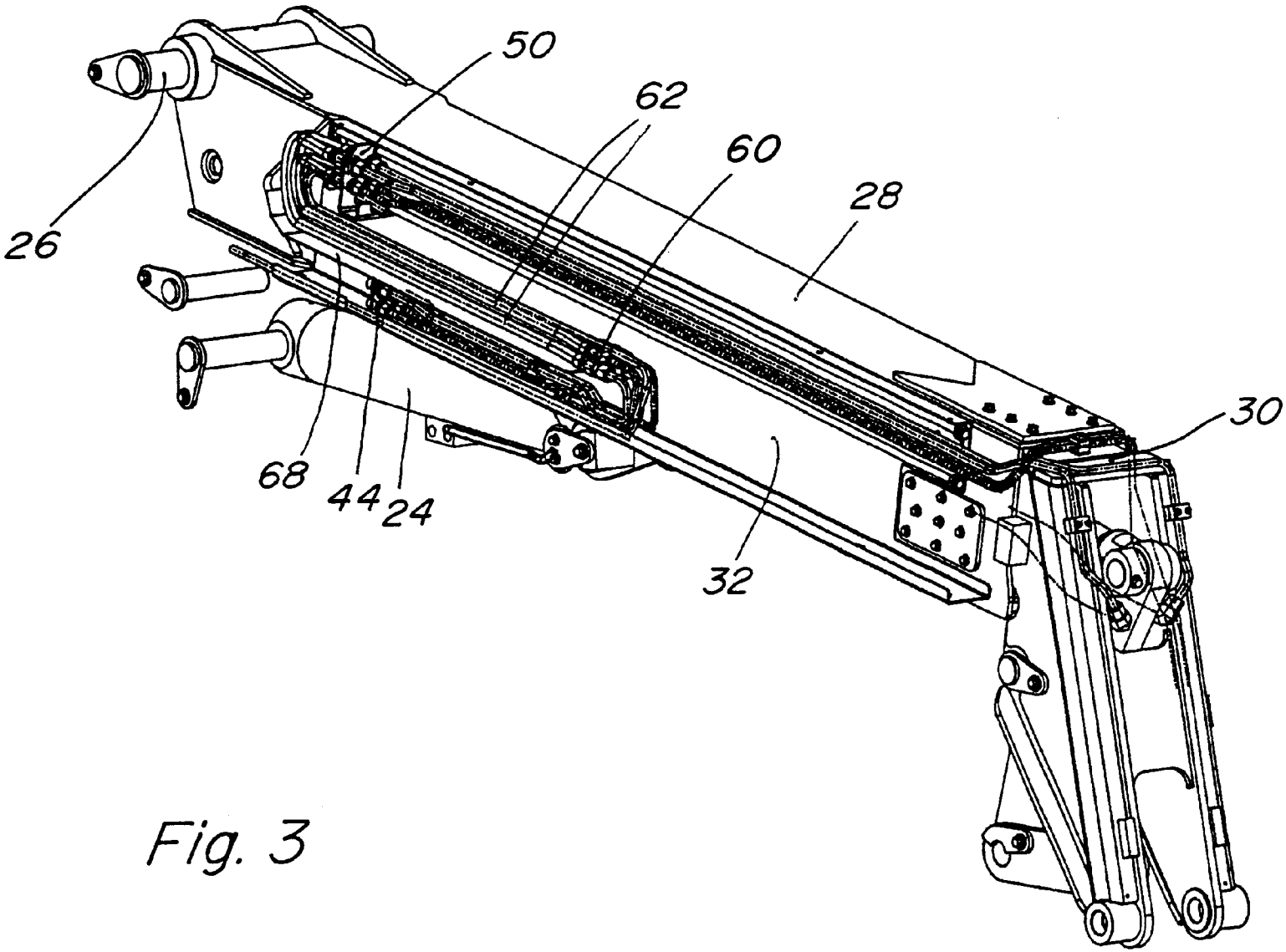
FIG. 3 is a view like FIG. 2 but showing the boom in a retracted position.

According to FIG. 2, the boom 20 is fully extended. Here the second receptacle 50 is located at the extreme right side of the guidance arrangement. The upper leg of the J-shaped or U-shaped bow 64 of the flexible hoses 62 is considerably longer than their lower leg. According to FIG. 3, the boom 20 is fully retracted. Here the second receptacle 50 is located at the extreme left side of the guidance arrangement. Here the upper leg of the J-shaped or U-shaped bow 64 of the flexible hoses is considerably shorter than its lower leg.

The flexible hoses 62 are two twin hoses. The twin hoses located radially inward in the bow 64 have a smaller cross section and are move flexible than the twin hoses located radially outward in the bow 64.

A support wall 68 extending in the longitudinal direction is fastened to the base frame 34 underneath the bow 64 of the flexible hoses 62. When the boom 20 is horizontal, this support wall 68 is generally directed horizontally and is used to support and guide the twin hoses 62.

The base frame 34 can be fastened together with the receptacles 44 and 50, the rigid tubes 52 and the flexible hoses 62 as a pre-assembled unit by means of screws, not shown, to the outer boom 28. After this attachment, the ends of the rigid tubes 52 located in the region of the first receptacle 44 are connected over screw connections with tube lines, that cannot be recognized in the drawings, and that are routed rigidly on the outer boom 28. The ends of the flexible hoses located in the region of the second receptacle 50 are connected by means of screw connections with tube lines 70 routed rigidly on the inner boom 30. Thereby the tube lines 70 routed rigidly on the inner boom 30 are connected with the second receptacle 50 to cause it to shift upon retraction and extension of the inner boom 30.

The tubes and hoses shown are hydraulic lines, that supply hydraulic cylinders, not shown, with hydraulic pressure in order to move the implement 22 relative to the boom 20. In addition to or in place of these hydraulic lines, further transmission lines can be arranged in a corresponding manner on the mounting frame 32, that are used for the transmission of hydraulic, electric and/or pneumatic power and/or the transmission of signals in order to drive, for example, hydraulic or pneumatic cylinders, valves or electric motors or to accept their measured values. Such transmission lines arranged on the mounting frame 32 can be connected by means of couplings, screw connections, plug-in connections and/or other simple means whit transmission lines and operating transmission lines rigidly routed on the outer boom 28 and the inner boom 30.

FIG. 5 reveals an alternative configuration for the guidance arrangement. In place of the guide rods 46 and 48, a guide rail 72 fastened to the base frame 34, extending in the longitudinal direction is used, whose upper edge 74 and whose lower edge 76 in each case is angled in a U-shape and forms guides for the sliding bearings 78 and 80 fastened to the second receptacle 50.

Although the invention has been described in terms of only one embodiment, anyone skilled in the art will perceive many varied alternatives, modifications and variations in light of the foregoing description as well as the drawings all of which fall under the present invention as defined in the accompanying claims.

What is claimed is:

1. A mounting frame for transmission lines of a telescopic boom including at least an outer fixed boom in which is mounted an inner boom for extending and retracting relative to said outer boom, comprising: said mounting frame being elongate and adapted for being mounted along said outer boom; a fixed receptacle mounted to said mounting frame at a first location close to one end of the mounting frame; a guide arrangement extending lengthwise of said mounting frame; a second receptacle mounted for movement along said guide arrangement; transmission lines extending between and being secured to said first and second receptacles and being sufficiently long to define at least one bow between said receptacles; and said transmission lines being flexible at least in a region including said at least one bow.

2. The mounting frame according to claim 1 wherein said slide arrangement is offset to the side with respect to said first receptacle relative to the longitudinal direction of the mounting frame.

3. The mounting frame according to claim 1 wherein said at least one bow is U-shaped or J-shaped, with the shape changing from one to the other in accordance with the position of said second receptacle along said guide arrangement.

4. The mounting frame according to claim 1 wherein at least one of said receptacles is in the form of a bulkhead extending transverse to the longitudinal direction of the mounting frame and is provided with recesses receiving and retaining said transmission lines.

5. The mounting frame according to claim 1 wherein said transmission lines are proved, at least in the region of said receptacles, with connecting elements for establishing a connection to external lines.

6. The mounting frame according to claim 1 wherein said guide arrangement includes at least two parallel guide rods; and said second receptacle having sliding bearings respectively received for movement along said guide rods.

7. The mounting frame according to claim 1 wherein said guide arrangement includes a guide rail extending generally in the longitudinal direction of the mounting frame; and said second receptacle being so configured and mounted that it is guided by and slides freely along said guide rail.

8. The mounting frame according to claim 1 wherein said mounting frame further includes a longitudinally extending support wall arranged for supporting and guiding said bow as said second receptacle moves toward and away from said first receptacle along said guide arrangement.

9. The mounting frame according to claim 1 wherein said transmission lines include at least a first transmission line that is more flexible than a second transmission line; and said second transmission line being arranged further radially outward in said bow than said first transmission line.

10. The mounting frame according to claim 1 wherein at least one transmission line includes rigid and flexible sections, with said rigid section extending from said first receptacle and being coupled to said flexible section, the latter forming part of said bow.

11. The mounting frame according to claim 1 wherein said mounting frame includes a base frame to which said first receptacle and said guide arrangement are fixed; and a cover releasably mounted to, and cooperating with, said mounting frame for enclosing said receptacles, guide arrangement and transmission lines.

12. A vehicle boom assembly, comprising: a first boom section; a second boom section mounted to said first boom section for sliding relative to it so as to effect extension and retraction of said boom assembly; an elongate transmission line mounting frame extending along and being secured to said first boom section; a first section of transmission lines being mounted to said mounting frame; a guide arrangement secured to and extending along said frame in a direction of sliding movement of said second boom section; a slide mounted for movement along said guide arrangement and having first ends of said first section of transmission lines secured thereto for movement therewith; and a second section of transmission lines being mounted to said second boom section and having respective ends coupled to said first ends of said first section of transmission lines.

* * * * *